US009732450B2

(12) United States Patent
Halsberghe et al.

(10) Patent No.: US 9,732,450 B2
(45) Date of Patent: Aug. 15, 2017

(54) GIVER RAPIER HEAD, GIVER RAPIER, RAPIER WEAVING MACHINE AND METHOD FOR INSERTING A WEFT THREAD IN SUCH A RAPIER WEAVING MACHINE USING SUCH A GIVER RAPIER HEAD

(71) Applicant: NV MICHEL VAN DE WIELE, Kortrijk/Marke (BE)

(72) Inventors: Brecht Halsberghe, Kuurne (BE); Vincent Lampaert, Vichte (BE); Steven Debaes, Rekkem (BE)

(73) Assignee: NV MICHEL VAN DE WIELE, Kortrijk/Marke (BE)

( * ) Notice: Subject to any disclaimer, the term of this patent is extended or adjusted under 35 U.S.C. 154(b) by 0 days.

(21) Appl. No.: 15/031,976

(22) PCT Filed: Oct. 24, 2014

(86) PCT No.: PCT/IB2014/065574
§ 371 (c)(1),
(2) Date: Apr. 25, 2016

(87) PCT Pub. No.: WO2015/059664
PCT Pub. Date: Apr. 30, 2015

(65) Prior Publication Data

US 2016/0273136 A1 Sep. 22, 2016

(30) Foreign Application Priority Data

Oct. 24, 2013 (BE) ..... 2013/0717
Mar. 19, 2014 (BE) ..... 2014/0180

(51) Int. Cl.
*D03D 47/23* (2006.01)
*D03D 49/50* (2006.01)

(52) U.S. Cl.
CPC ..... *D03D 47/236* (2013.01)

(58) Field of Classification Search
CPC .... D03D 47/233; D03D 47/20; D03D 47/236; D03D 47/23; D03D 47/273; D03D 47/275; D03D 47/271
See application file for complete search history.

(56) References Cited

U.S. PATENT DOCUMENTS 4,875,507 A * 10/1989 Debaes ..... D03D 47/34 139/450
5,033,516 A * 7/1991 Debaes ..... D03D 47/275 139/449

(Continued)

FOREIGN PATENT DOCUMENTS

DE 2428009 A1 1/1975
DE 2644343 A1 4/1977

(Continued)

OTHER PUBLICATIONS

International Search Report Dated Mar. 26, 2015.

*Primary Examiner* — Bobby Muromoto, Jr.
(74) *Attorney, Agent, or Firm* — Symbus Law Group, LLC; Clifford D. Hyra

(57) ABSTRACT

A giver rapier head (1) comprises a presentation space (9) between a successive guide nose (11), for leading off warp threads (23) on one side (7), and a selection nose (8), for leading off warp threads (23) on the other side, so that a weft thread (2) can be directly presented in this presentation space (9) and can engage from there in an insertion space (15) between the selection nose (8) and the first-mentioned side (7). A giver rapier (1) has a limit guide arc (10) which is arranged at the front side of the giver rapier (1) and a selection nose (8) which is arranged on the top side, with its top (26) facing the guide arc (10).
A rapier weaving machine (20) comprises such a giver rapier head (1). In a method for inserting a weft thread (2), the (Continued)

giver rapier head (1) is moved towards this weft thread (2) while the reed (19) beats up an inserted weft thread (2).

25 Claims, 7 Drawing Sheets

(56) References Cited

U.S. PATENT DOCUMENTS 5,113,914 A * 5/1992 Corain ..... D03D 47/233 139/448
5,123,454 A * 6/1992 Debaes ..... D03C 7/06 139/54
5,271,434 A * 12/1993 Debaes ..... D03D 47/23 139/448
5,862,837 A * 1/1999 Guenther ..... D03D 47/233 139/438
6,105,626 A * 8/2000 Debaes ..... D03D 47/236 139/448
6,988,516 B2 * 1/2006 Debaes ..... D03D 47/275 139/441
7,810,526 B2 * 10/2010 Yamashita ..... D03D 47/20 139/448
2002/0166600 A1 * 11/2002 Verclyte ..... D03D 47/233 139/222
2008/0105326 A1 * 5/2008 D' Incau ..... D03D 47/271 139/448
2009/0293983 A1 * 12/2009 Christe ..... D03D 47/277 139/448
2010/0206423 A1 * 8/2010 Yamashita ..... D03D 47/233 139/448
2016/0273136 A1 * 9/2016 Halsberghe ..... D03D 47/236

FOREIGN PATENT DOCUMENTS

DE 19537329 A1 4/1997
EP 0310767 A1 4/1989

* cited by examiner

GIVER RAPIER HEAD, GIVER RAPIER, RAPIER WEAVING MACHINE AND METHOD FOR INSERTING A WEFT THREAD IN SUCH A RAPIER WEAVING MACHINE USING SUCH A GIVER RAPIER HEAD

This application claims the benefit of Belgian patent Application Nos. BE-2013/0717, filed Oct. 24, 2013 and BE-2014/0180, filed Mar. 19, 2014, which are hereby incorporated by reference in their entireties.

FIELD OF THE INVENTION

The present invention relates to a giver rapier head for inserting a weft thread in a rapier weaving machine.

Furthermore, the present invention relates to a giver rapier comprising such a giver rapier head.

In addition, the present invention relates to a rapier weaving machine comprising such a giver rapier head. More specifically, the present invention relates to a double-face weaving machine, but is not limited thereto.

Furthermore, the present invention relates to a method for inserting a weft thread in such a rapier weaving machine using such a giver rapier head.

The invention relates to a giver rapier head for weaving machines which operate according to the principle of divided rapiers. Such giver rapier heads are known, for example, from U.S. Pat. No. 5,113,914, DE 26 44 343 A1, DE 24 28 009 A1, DE 195 37 329 A1 and EP 0 310 767 A1. U.S. Pat. No. 5,113,914 in this case specifically describes a giver rapier head which is optimized for high weaving speeds.

With such weaving machines, the so-called rapier weaving machines, rapier bars are fitted on both sides of the weaving machines in order to insert the weft threads between warp threads in a shed. The overall insertion cycle is divided into three stages: the presentation stage, the insertion stage and the pulling-through stage. During the presentation stage, a weft thread is presented to a giver rapier head. During the insertion stage, the rapiers move forward together on the way there, from a starting position, in the shed to the centre of the fabric. While moving backwards (pulling-through stage), the rapiers move from the centre to the starting position. In the starting position, the weft thread which is presented to the giver rapier head is carried along by this giver rapier head into the shed. In the centre of the fabric, the weft thread is transferred by a taker rapier head and during the return movement (pulling-through stage), the weft thread is pulled through the shed by this taker rapier from the centre of the fabric up to the fabric edge.

The giver rapier heads to which the invention relates are not driven in order to achieve this. These giver rapier heads are thus not actively opened or closed in order to carry a weft thread along.

In this connection, the difficulty is to ensure that the weft threads are carried along in the shed between the warp threads without carrying along these warp threads. To this end, such a non-driven giver rapier head always comprises a nose for gripping a weft thread to be inserted underneath/behind it. Furthermore, such a non-driven giver rapier head comprises guide arcs for, on the one hand, guiding a weft thread to be inserted under/behind this nose and, on the other hand, freely guiding the warp threads across the nose. In order to make this possible, weft yarns are always presented to such a giver rapier head at different angles to the angle at which warp yarns are arranged with respect to this giver rapier head.

After the insertion of weft threads in a shed between the warp yarns on a rapier weaving machine, the inserted weft threads are beaten up by the weaving reed.

The weft threads are cut between two insertion cycles along the fabric selvedge by means of a cutting device.

With the existing double-face weaving machines, the cutting device is attached to the batten for this purpose. This results in additional weight to one side of this batten. This cutting device moves along with the batten, so that the inertia of this cutting device results in additional mass forces on the batten. This is particularly disadvantageous with high weaving speeds, at which this additional mass which is positioned in an unbalanced manner produces forces which cause vibrations.

However, with the current giver rapier heads for double-face weaving machines, it is not possible to arrange the cutting device separately from the batten, i.e. fixed in the weaving machine. In addition, the giver rapier heads are also relatively heavy, which also has a negative effect on the upper limit of the operating speed of the weaving machine.

With flat weaving machines, the cutting device is fixedly arranged in the weaving machine. However, the giver rapier heads which are used for this purpose in such weaving machines are still too heavy, and these giver rapier heads, due to their weight, are therefore also an impediment to increasing the weaving speeds.

If giver rapier heads from flat weaving machines were to be used as an alternative to the current giver rapier heads for double-face weaving machines, this would still mean a limitation of the achievable weaving speed, despite the increase in speed which could be produced by moving the cutting device.

On the other hand, it is still possible to achieve an increase in speed with the flat weaving machines by using lighter giver rapier heads.

Thus, there is nowadays still an upper limit regarding weaving speeds with the current rapier weaving machines due in part to the giver rapier heads which are employed.

It is the object of the present invention to further increase the weaving speeds of rapier weaving machines.

This object of the invention is achieved in a first manner by providing a giver rapier head for inserting a weft thread in a rapier weaving machine, comprising a guide nose which, viewed in the direction of movement for inserting a weft thread, forms the first component of the giver rapier head and which comprises a first guide arc which ends on the bottom side or the top side of the giver rapier head for freely guiding warp threads over said bottom side or top side of the giver rapier head respectively, wherein the giver rapier head furthermore comprises a selection nose which, viewed in said direction of movement, is positioned completely behind the guide nose at an intermediate distance, so that a presentation space extends over a certain distance between the guide nose and the selection nose for presenting therein a weft thread to be inserted to the giver rapier head, wherein said presentation space extends, viewed at right angles to the direction of movement, through the giver rapier head, with an access opening for the weft thread on the top side or the bottom side of the giver rapier head respectively, wherein an insertion space extends between the selection nose and the bottom side or the top side respectively, for allowing the weft thread to engage therein from the presentation space, wherein the selection nose comprises a second guide arc for freely guiding warp threads over the top side or the bottom side respectively, and wherein the point of the guide nose which is furthest from the bottom side or the top side respectively, is situated at least as far from said bottom side or said top side respectively, as the point of the selection nose which is situated furthest from the top side or the bottom side respectively, wherein the distance is measured along a direction which extends at right angles to said direction of movement from the bottom side to the top side.

If such a giver rapier head is fitted in a rapier weaving machine, the front side thereof will correspond with the front side of said rapier weaving machine. The top side, bottom side and rear side of the giver rapier head also correspond with the corresponding top side, bottom side and rear side of the rapier weaving machine in which it is fitted. In this case, the front side of the giver rapier head is turned towards the fabric line. In practice, this is usually also the side where the operator operates the rapier weaving machine.

In this case, the guide nose is situated closest to the selvedge of a fabric to be woven.

With such a construction, such a giver rapier head according to the present invention no longer has to be moved completely outside the zone next to the fabric selvedge, up to where weft threads to be presented extend, in order to grip a weft thread. During the pulling-through stage, during the backward movement, the guide nose no longer has to be moved beyond the weft threads to be inserted. It is possible to ensure that the rapier head is only moved outwards so far that a next weft thread to be inserted is situated at the location of the presentation space, viewed in the direction of movement for inserting a weft thread. Due to the fact that the giver rapier head, due to its specific construction, has to move less far outside the shed than the existing giver rapier heads, less time is required to move it. The drive for the giver rapier head can also be made less heavy, resulting in a possible gain in weaving speed.

Due to the fact that the presentation space extends through the giver rapier head, viewed at right angles to the direction of movement, there is sufficient space in this presentation space to present one or more weft threads to be inserted in this presentation space. Due to the specific shape with a first guide arc and presentation space, the yarns do not have to be at a specific angle with respect to the direction of movement of the giver rapier to this end in order to either be carried along or not carried along by the giver rapier head. Warp yarns are automatically kept out of range of the presentation space due to the shape of the giver rapier head and weft yarns enter therein just before they can be carried along for weft insertion. The difference in angle between warp yarns and weft yarns does not determine whether or not they will be carried along.

In order to carry these weft threads along using a giver rapier head according to the present invention irrespective of the angle at which such a weft thread is presented, for this purpose the presentation space typically has to extend for at least some 3 mm through the giver rapier head, viewed in the direction of movement. With more voluminous yarns, this may increase to approximately 40 to 50 mm. Typically, such a presentation space will extend through the giver rapier head for some 10 to 25 mm.

In addition, such a giver rapier head according to the present invention, due to its specific construction, offers the advantage for the different types of rapier weaving machines that it can be made more compact than the giver rapier heads which are currently used. Prior-art giver rapier heads comprise guide arcs which fulfill a double function for, on the one hand, guiding a weft thread to be inserted under a nose and, on the other hand, guiding warp threads freely over the nose. With said giver rapier head according to the present invention, such guide arcs with double function are no longer required. This giver rapier head does still comprise other guide arcs which, however, do not have this double function. By omitting guide arcs with this double function, this giver rapier head according to the present invention can be made more compact than a comparable giver rapier head according to the prior art. It can therefore also be made less heavy. As a result, a drive which is less heavy is needed to actuate the movement of such a giver rapier head, resulting in an increase in weaving speed compared to existing rapier weaving machines.

In addition, specifically with double-face weaving machines, such a giver rapier head according to the present invention also makes it possible to present a weft thread to the giver rapier head from the rear side. This makes it possible to no longer attach the cutting device to the batten, but to fit it in the weaving machine in a fixed location.

The guide nose of said giver rapier head according to the present invention is preferably arranged at the front side of the giver rapier head. The selection nose is preferably also arranged at the front side of the giver rapier head.

In a particularly preferred embodiment, the presentation space is suitable for simultaneously presenting several weft threads to be inserted.

Preferably, the transition of the guide nose from the point of the guide nose, which is positioned furthest from the bottom side or the top side of the giver rapier head respectively, to the presentation space is smooth. In this way, warp yarns will not become caught behind this guide nose when the giver rapier head is moved backwards.

In a preferred embodiment of a giver rapier head according to the present invention, at the rear side or the top side or bottom side thereof, comprises a stop to allow the weft thread to strike against it. More specifically, such a giver rapier head may comprise a guide arc at its rear side for guiding the weft thread to said stop.

The object of the invention is achieved in a second way by providing a giver rapier head for inserting a weft thread in a rapier weaving machine, comprising a selection nose for gripping a weft thread to be inserted underneath it and comprising a guide arc for, on the one hand, guiding a weft thread to be inserted under the selection nose and, on the other hand, freely guiding warp threads over the selection nose, wherein said guide arc ends in a point which, viewed in a direction of movement of the giver rapier head for inserting a weft thread, is arranged as a first point of the giver rapier head, wherein the guide arc is arranged at the front side of the giver rapier head and wherein the selection nose is arranged at the top or bottom side of the giver rapier head, virtually completely behind the guide arc and with the top of the selection nose facing the guide arc.

Preferably, the selection nose of such a giver rapier head according to the present invention is arranged completely behind the guide arc.

If such a giver rapier head is fitted in a rapier weaving machine, front side thereof will correspond with the front side of said rapier weaving machine. The top side, bottom side and rear side of the giver rapier head also correspond with the corresponding top side, bottom side and rear side of the rapier weaving machine in which it is fitted. In this case, the front side of the giver rapier head is turned towards the fabric line. In practice, this is usually also the side where the operator operates the rapier weaving machine.

The point into which the guide arc ends is then in this case situated closest to the selvedge of a fabric to be woven.

Such a giver rapier head according to the present invention offers the advantage for the different types of rapier weaving machines that it can be made more compact than the giver rapier heads which are currently used and thus can also be made less heavy. The drive required to actuate the movement of such a giver rapier head can therefore be made less heavy, resulting in an increase in weaving speed compared to existing rapier weaving machines.

In addition, such a giver rapier head according to the present invention should move less far outside the shed to grip a weft thread, than the existing giver rapier heads, due to its specific construction where the top of the selection nose faces the guide arc. Due to the fact that the giver rapier head moves less far than has hitherto always been the case, the drive of the giver rapier head can again be made less heavy, resulting in a possible gain in weaving speed.

In addition, specifically with double-face weaving machines, such a giver rapier head according to the present invention also makes it possible to present a weft thread to the giver rapier head from the rear side. This makes it possible to no longer attach the cutting device to the batten, but to fit it in the weaving machine in a fixed location.

A preferred embodiment of such a giver rapier head according to the present invention only comprises said guide arc for, on the one hand, guiding a weft thread to be inserted under the selection nose and, on the other hand, freely guiding warp threads over the selection nose.

Giver rapier heads according to the prior art in which the nose of the giver rapier head is arranged virtually completely behind the guide arc also comprise, on the opposite side of the nose, a guide arc which has this double function and which, to this end, is arranged virtually completely behind the nose. With this preferred embodiment of a giver rapier head according to the present invention, this guide arc on the rear side is no longer present. If desired, this giver rapier head may still comprise other guide arcs which do not then have this double function. By omitting a second guide arc with this double function, the giver rapier head according to the present invention can be made even more compact than a comparable giver rapier head according to the prior art. In addition, it can thus be modified so that it matches the direction of the weft threads to be carried along even better, so that it has to move less far outside the shed in order to carry along such a weft thread.

A particularly preferred embodiment of a giver rapier head according to the present invention is configured as a tubular body which is made from folded sheet material. Making such a giver rapier head from sheet material is a simple way of making it lighter in weight.

In this case, such a giver rapier head made of sheet material may be made from one single sheet part, but may, if desired, also be made from several constituent sheet parts.

The use of sheet material offers the additional advantage that additional transition elements can be provided in one component. With a compact giver rapier head, this offers the advantage that adapted transition elements can be provided, so that warp threads can be guided freely over components adjacent to the giver rapier head. This is advantageous, for example, with regard to drive components, such as for example a drive rod to which the giver rapier head is attached.

Furthermore, a giver rapier head according to the present invention may, more specifically, be hollow and comprise a movable clamping element for clamping a weft thread which has been gripped behind the selection nose, which can advantageously be arranged here in the space of the giver rapier head, substantially against the front side of the giver rapier head.

A giver rapier head according to the present invention is furthermore preferably attachable to a flexible drive belt or to a rigid drive rod, in order to thus together form a giver rapier according to the present invention.

In addition, the object of the present invention is also achieved by providing a rapier weaving machine, comprising a giver rapier head according to the present invention.

Preferably, the giver rapier head in such a rapier weaving machine according to the present invention is arranged so as to be displaceable between a first limit position in which a weft thread to be inserted is situated at the location of a central part of this giver rapier head, viewed in the direction of movement for inserting a weft thread, and a second limit position in which the giver rapier head is situated virtually midway along a fabric to be woven using the weaving machine. With a giver rapier head having a presentation space, the weft thread is then preferably at the location of this presentation space in the first limit position.

A rapier weaving machine according to the present invention with a reed for beating up an inserted weft thread preferably comprises a guide element, which is arranged at a fixed position, for guiding a next weft thread to be inserted, which is still attached to the inserted weft thread, when the reed beats up the already inserted weft thread in order to present the next weft thread to be inserted to the giver rapier head. When the giver rapier head is a giver rapier head according to the present invention with a presentation space, then the guide element is preferably configured to guide a next weft thread to be inserted, which is still attached to the inserted weft thread, when the reed beats up the already inserted weft thread in order to present the next weft thread to be inserted over the guide nose of the giver rapier head in the presentation space of the giver rapier head.

Depending on the parameters of the rapier weaving machine, such a guide element may optionally either be arranged in front of or behind the giver rapier head and thus be either closer or further from the fabric line.

A rapier weaving machine according to the present invention furthermore preferably comprises a cutting device for cutting a weft thread to be inserted from an already inserted weft thread, in which said cutting device is arranged at a fixed position in the rapier weaving machine.

With double-face weaving machines, this results, more specifically, in the enormous advantage that this cutting device is no longer arranged on the batten and will therefore no longer be moved along with this batten. Therefore, this mass no longer has to be accelerated with the batten.

Very advantageously, in a rapier weaving machine according to the present invention which comprises a positioning element for positioning a weft thread to be inserted, this positioning element is arranged behind the giver rapier head in the rapier weaving machine and this positioning element is arranged further from the position in the weaving machine, where a new fabric to be woven is formed, than the giver rapier head.

If, in such an arrangement of the positioning element with respect to the giver rapier head, a weft thread is presented to the giver rapier head, this giver rapier head only has to move slightly beyond the selvedge of the fabric to be woven in order to be able to grip this weft thread. Keeping the extra motion to a minimum means that the time the extra motion takes is kept to a minimum, the drive can be reduced and thus the weaving speed can be increased.

In a specific rapier weaving machine according to the present invention, the selection nose of the giver rapier head is arranged substantially according to the direction of the projection of a weft thread which has been presented by said positioning element on the top side of the giver rapier head in order to be able to keep the required motion of the giver rapier head beyond the selvedge to a minimum.

Particularly preferably, a rapier weaving machine according to the present invention is a double-face weaving machine. More specifically, in this application, a double-face weaving machine has two or three rapier systems which each comprise a taker and giver rapier and which each have a cutting device.

The object of the present invention is in addition achieved by providing a method for inserting a weft thread in a rapier weaving machine according to the present invention, comprising a reed for beating up an inserted weft thread, in which, when the reed beats up an already inserted weft thread, which is still attached to a next weft thread to be inserted, the next weft thread to be inserted is moved towards the giver rapier head by the movement of the reed in order to present it to the giver rapier head. The required motion of the giver rapier head beyond the selvedge of the fabric is thus limited.

If this giver rapier head is a giver rapier head according to the present invention with a presentation space, then the movement of the reed in this case moves the next weft thread to be inserted preferably towards the giver rapier head, so that this weft thread to be inserted is situated at the location of the presentation space, viewed in the direction of movement for inserting a weft thread. In a first specific embodiment of such a method according to the present invention, when the reed beats up an already inserted weft thread, which is still attached to a next weft thread to be inserted, the next weft thread to be inserted is presented in the presentation space of the giver rapier head by the movement of the reed. Still more preferably, the weft thread is in this case also introduced as far as into the insertion space.

If this giver rapier head is a giver rapier head according to the present invention according to the second way, then, in a method according to the present invention, the movement of the reed moves the next weft thread to be inserted preferably towards the giver rapier head, so that the selection nose of the giver rapier head grips the weft thread to be inserted underneath.

These methods in which the weft thread is introduced into the presentation space or more preferably into the insertion space of the giver rapier head when the reed is beating up, or is taken underneath the selection nose of the giver rapier head, are particularly suitable for those cases where no colour selection is required. By inserting a next weft thread to be inserted in the presentation space or more preferably in the insertion space of the giver rapier head, or underneath the selection nose of the giver rapier head, by means of the movement of the reed—when an inserted weft thread is beaten up—this weft thread to be inserted is stabilised when an inserted weft thread is beaten up and the weaving speed is increased still further. The required motion of the giver rapier head beyond the selvedge of the fabric is thus reduced still further.

If, in a method according to the present invention, the rapier weaving machine in which the giver rapier head is a giver rapier head with a presentation space, comprises an above-described guide element, this guide element guides the weft thread to be inserted over the guide nose of the giver rapier head preferably when the reed beats up an already inserted weft thread which is still attached to a next weft thread to be inserted.

If, in such a method, the rapier weaving machine comprises a selection apparatus for selecting a weft thread to be inserted and presenting said weft thread to the giver rapier head, then this selection apparatus preferably only selects a next weft thread to be inserted after an already inserted weft thread has been beaten ip by the reed, so that said next weft thread to be inserted is presented in the presentation space of the giver rapier head.

If, in a method according to the present invention, the rapier weaving machine comprises an above-described cutting device and comprises a giver rapier head which comprises an abovementioned movable clamping element, then this cutting device cuts the weft thread to be inserted from the already inserted weft thread, preferably after the weft thread to be inserted has engaged behind the selection nose of the giver rapier head and after said weft thread has been clamped with the clamping element.

The present invention will now be explained in more detail by means of the following detailed description of some embodiments of a giver rapier head, a rapier weaving machine and a method according to the present invention. The aim of this description is solely to give illustrative examples and to indicate further advantages and features of the invention, and can thus not be interpreted as a limitation of the area of application of the invention or of the patent rights defined in the claims.

In this detailed description, reference numerals are used to refer to the attached drawings, in which FIG. 1 diagrammatically shows a double-face weaving machine in cross section;

FIG. 2 diagrammatically shows in a top view at the location of a first embodiment of a giver rapier head how a giver rapier head according to the present invention may be arranged in a weaving machine with respect to a weft thread to be inserted;

Figure 1:
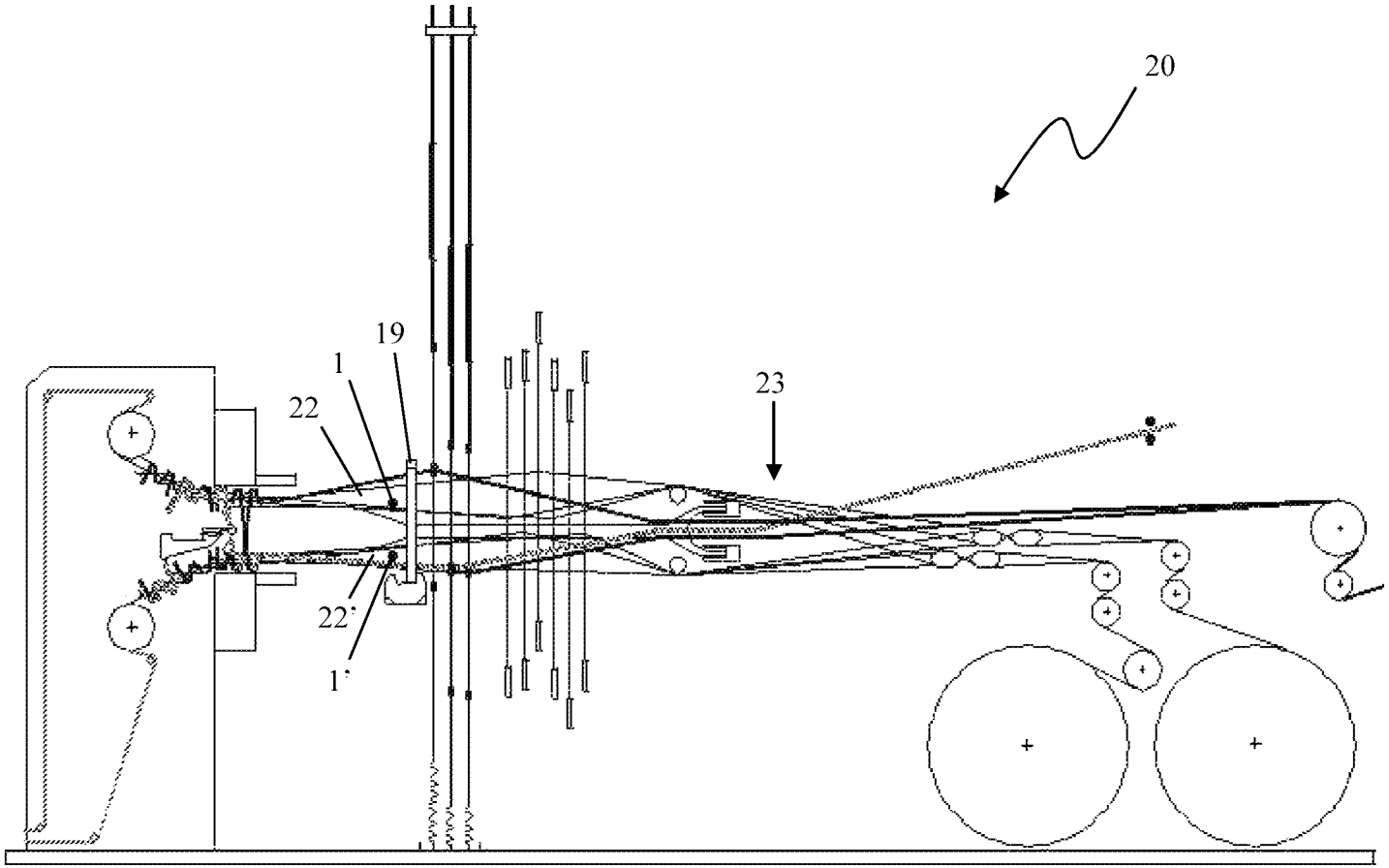
Figure 12:
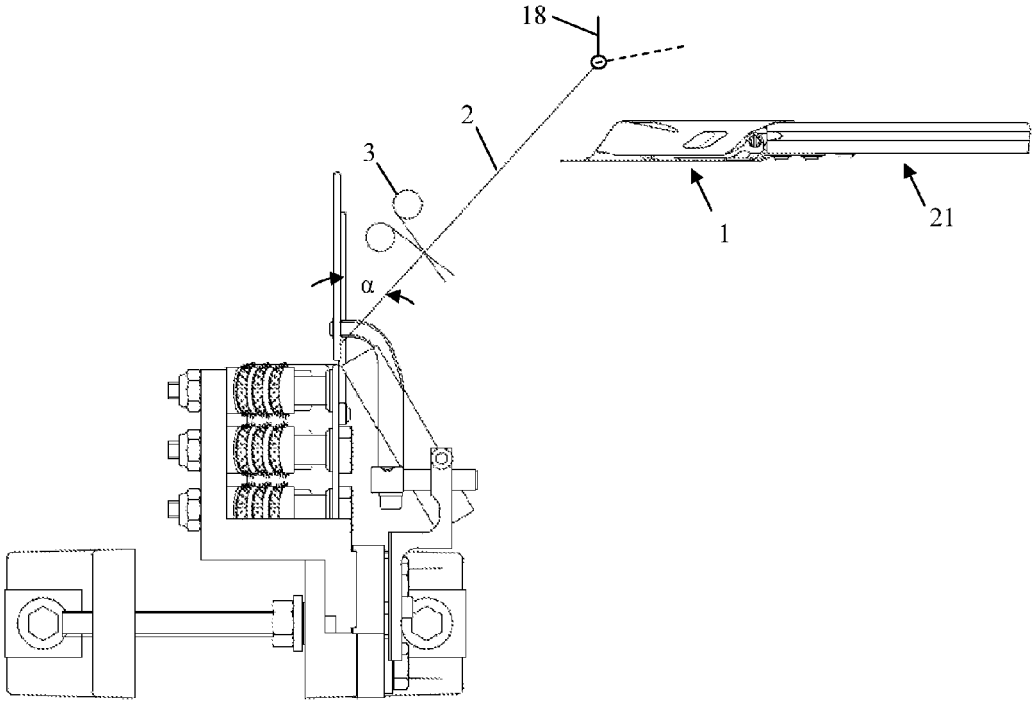
Figure 13:
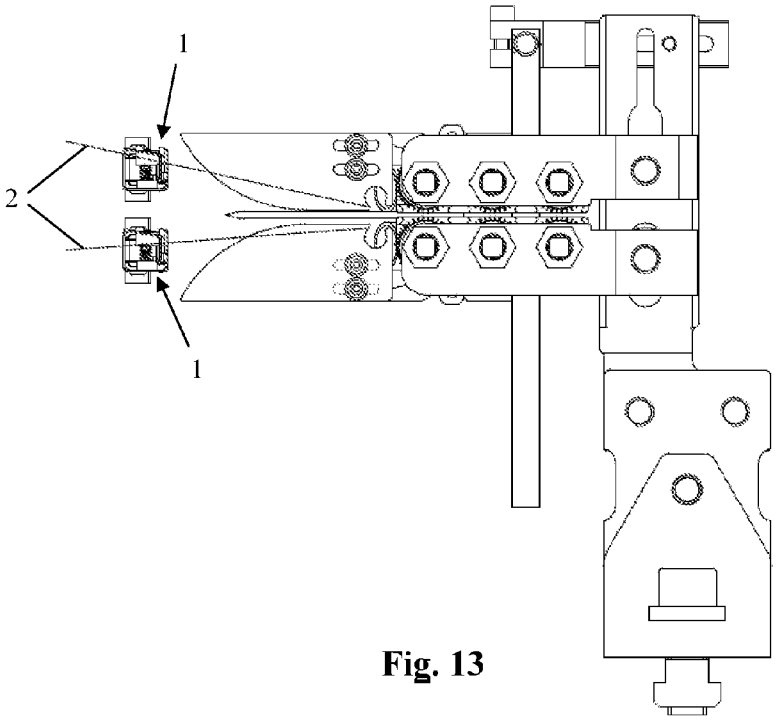
Figure 14:
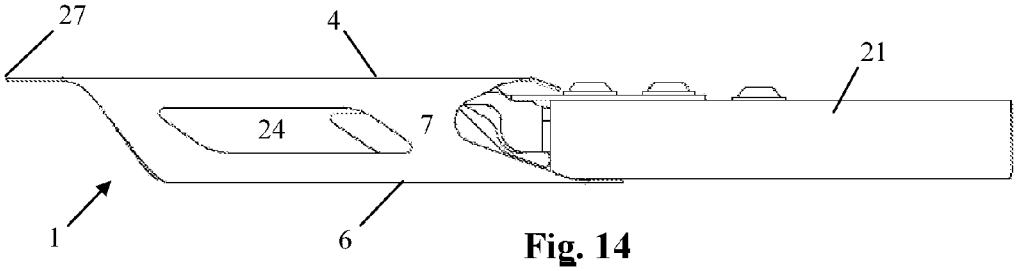
Figure 15:
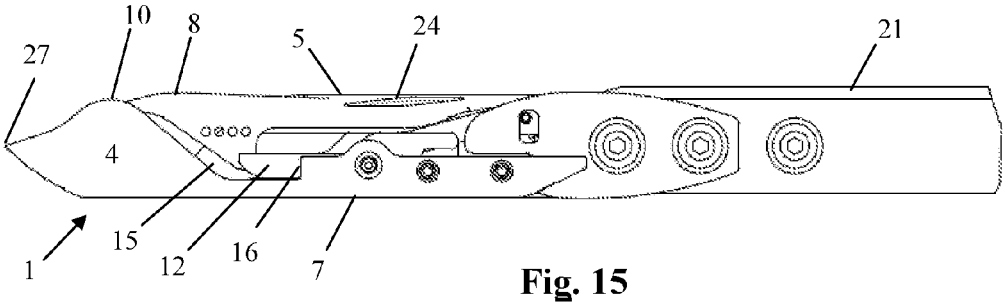
Figure 16:
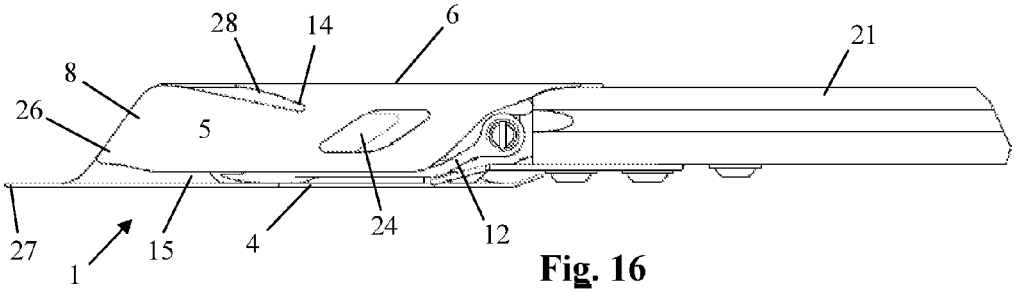
Figure 17:
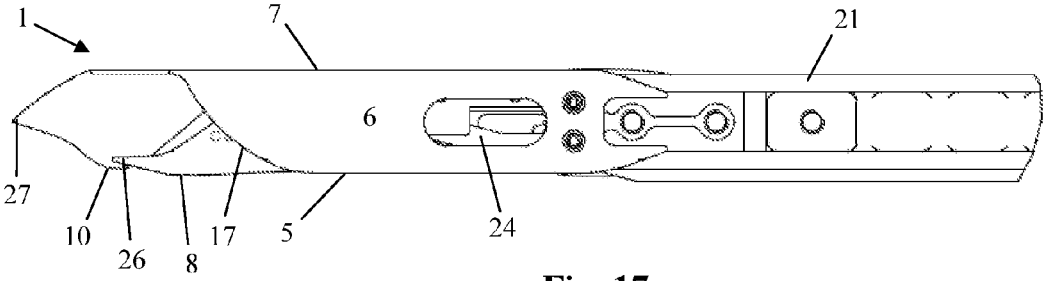
Figure 18:
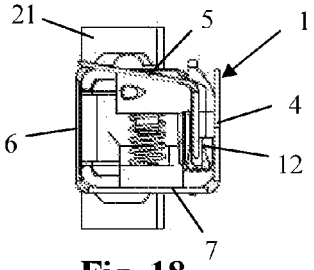
Figure 19:
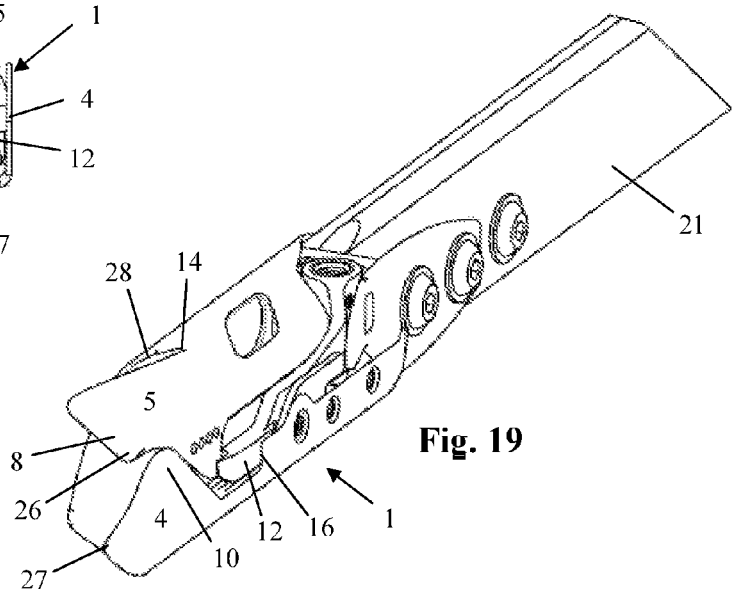
Figure 20:
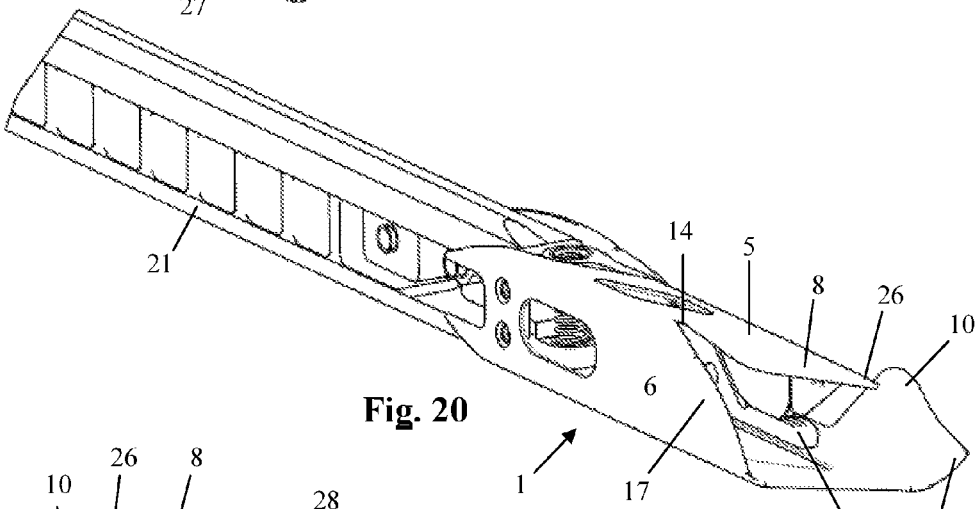
Figure 21:
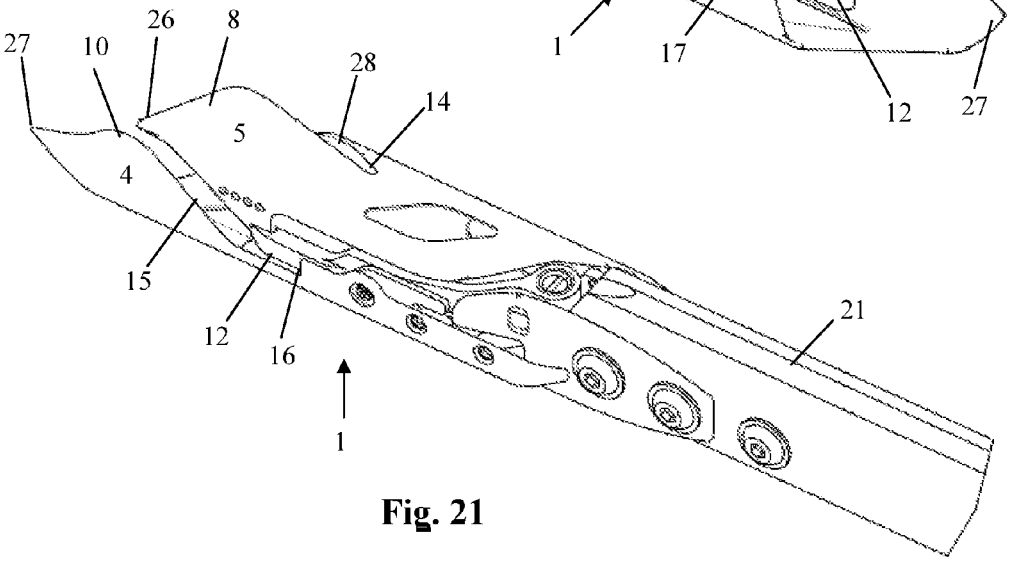

FIG. 12 diagrammatically shows in top view at the location of a second embodiment of a giver rapier head how a giver rapier head according to the present invention may be arranged in a double-face weaving machine as illustrated in FIG. 1 with respect to a weft thread to be inserted;

FIG. 13 diagrammatically shows the arrangement from FIG. 12 in side view;

FIG. 14 shows a second embodiment of a giver rapier head according to the present invention in bottom view, in the fitted position, fitted to a drive rod which is only partly shown;

FIG. 15 shows the giver rapier head with part of a drive rod from FIG. 14 in front view;

FIG. 16 shows the giver rapier head with part of a drive rod from FIG. 14 in top view;

FIG. 17 shows the giver rapier head with part of a drive rod from FIG. 14 in rear view;

FIG. 18 shows the giver rapier head with part of a drive rod from FIG. 14 in side view, viewed from the left in FIG. 15;

FIG. 19 shows the giver rapier head with part of a drive rod from FIG. 14 in perspective, viewed from the front left in FIG. 15;

FIG. 20 shows the giver rapier head with part of a drive rod from FIG. 14 in perspective, viewed from the back left in FIG. 15;

FIG. 21 shows the giver rapier head with part of a drive rod from FIG. 14 in perspective, viewed from the front right in FIG. 15.

In a double-face weaving machine (20) as illustrated in FIG. 1, warp threads (23) are fed from a warp yarn store at the rear side of the weaving machine (20) (on the right in FIG. 1) to the front side of the weaving machine (20). The warp threads (23) are spread in order to form a top (22) and a bottom shed (22') in between. A corresponding top giver rapier head (1) and a corresponding bottom giver rapier head (1') are arranged on one side of the weaving machine (20) in order to be able to introduce weft threads (2) into the top shed (22) and the bottom shed (22') respectively. After inserting weft threads (2) in the corresponding shed (22, 22'), the inserted weft threads (2) are beaten up against the already woven fabric on the front side of the weaving machine (20) by means of a reed (19). If desired, the position of the warp threads (23) is changed (above-below the shed) in order to form a shed (22) again for inserting a next weft thread (2).

Figure 2:
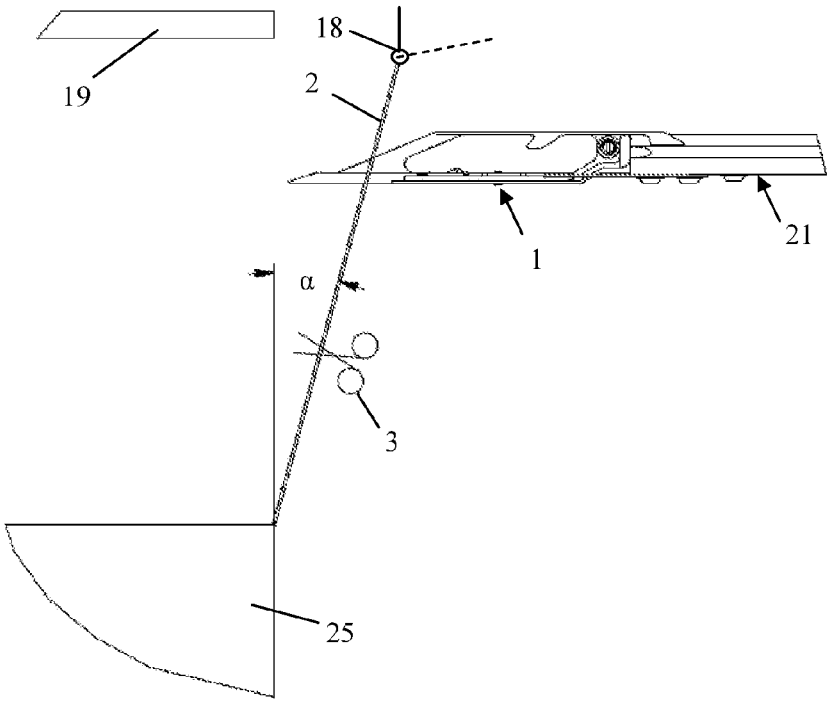
Figure 3:
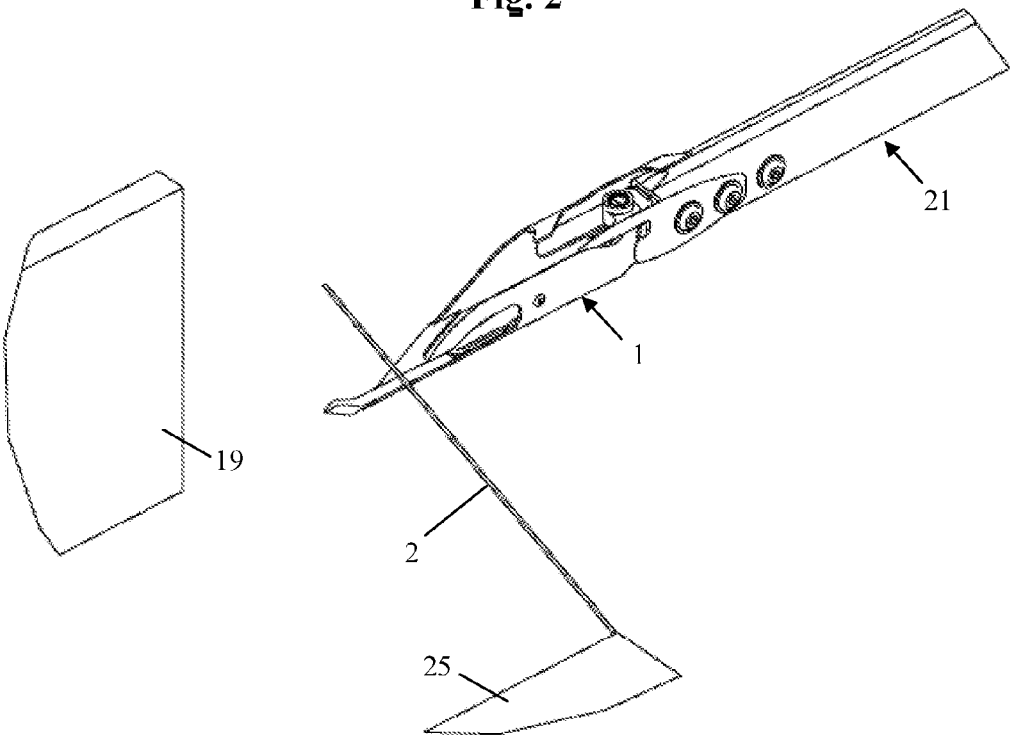
FIG. 3 shows a perspective view of the arrangement from FIG. 2.

In FIGS. 2 to 21, a top giver rapier head (1) is illustrated in each case. The bottom giver rapier head (1') may be identical to the top giver rapier head (1), as is illustrated, for example, in FIG. 3 or FIG. 12, provided that the weft threads (2) can be presented in a suitable manner with respect to this bottom giver rapier head (1'). Alternatively, this bottom giver rapier head (1') may for example also be a mirror image of the top giver rapier head (1) with respect to a virtually horizontal plane between the top shed (22) and the bottom shed (22') (viewed with respect to the weaving machine (20) as illustrated in FIG. 1). In that case, the means for presenting and cutting the corresponding weft threads (2) are preferably—but not in a limiting way—selected so as to be mirrored with respect to this same horizontal plane. Below, the components of the weaving machine (20) and method for inserting a weft thread (2) are described only in connection with the top giver rapier head (1). It is obvious that this also applies mutatis mutandis to the bottom giver rapier head (1').

In contrast with the current double-face weaving machines, a weft thread (2) still remains attached to the already woven fabric after inserting a weft thread (2) in a shed (22) until the giver rapier head (1) has gripped this weft thread (2) again. In FIGS. 2, 3, 12 and 13, the situation where this weft thread (2) is still attached to the already woven fabric before the giver rapier head (1) grips this weft thread (2) again can be seen. In FIGS. 2 and 3, the weft thread (2) in this case already extends in the presentation space (9) of the giver rapier head (1). A positioning element (18) for positioning the weft thread (2) is arranged behind and above the giver rapier head (1), so that this weft thread (2) is presented at an angle from above and behind this giver rapier head (1) to underneath and in front of this giver rapier head (1). The top view from FIGS. 2 and 12 shows the angle ($\alpha$) at which this weft thread (2) in this case extends with respect to the giver rapier head (1). In addition, this positioning element (18) is arranged further from the selvedge of a fabric to be woven using the weaving machine (20) than the giver rapier head (1).

The weaving machine (20) comprises a cutting device (3) for cutting an inserted weft thread (2) which is fixedly arranged in the weaving machine (20). Only after the giver rapier head (1) has gripped this weft thread (2) in order to insert a new piece of weft thread (2) into the shed (22), this weft thread (2) passes the cutting device (3) and is cut thereby.

The first embodiment of a giver rapier head (1) according to the present invention illustrated in FIGS. 2-11 is configured as a hollow, substantially tubular body having a front side (4), a top side (5) a rear side (6) and a bottom side (7).

On its top side (5), this tubular body (1) comprises a small hook-shaped element (14) as a rear stop for the weft thread (2) to strike against.

Figure 4:
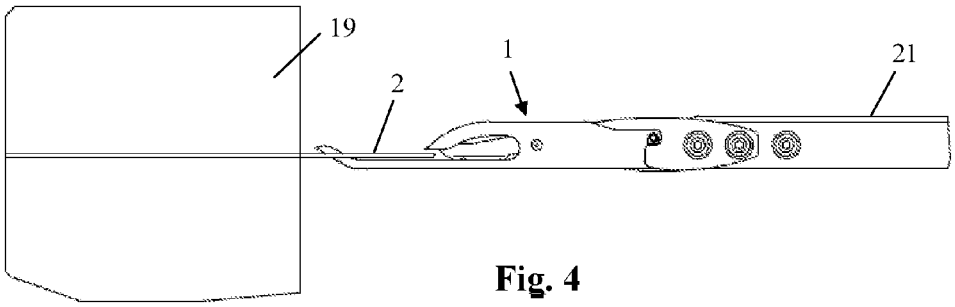
FIG. 4 shows the arrangement from FIG. 2 in front view.
Figure 5:
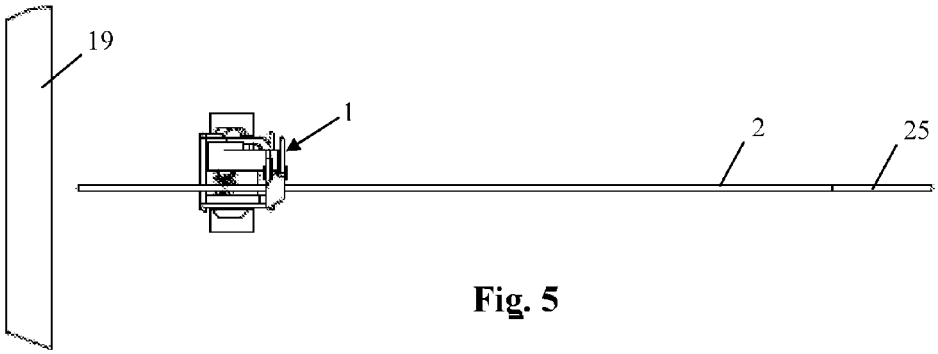
FIG. 5 shows the arrangement from FIG. 2 in side view.
Figure 6:
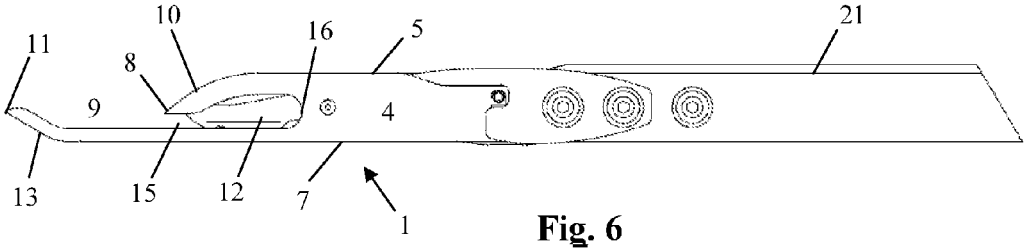
FIG. 6 shows a first embodiment of a giver rapier head according to the present invention in front view, in the fitted position, fitted to a drive rod which is only partly shown.
Figure 7:
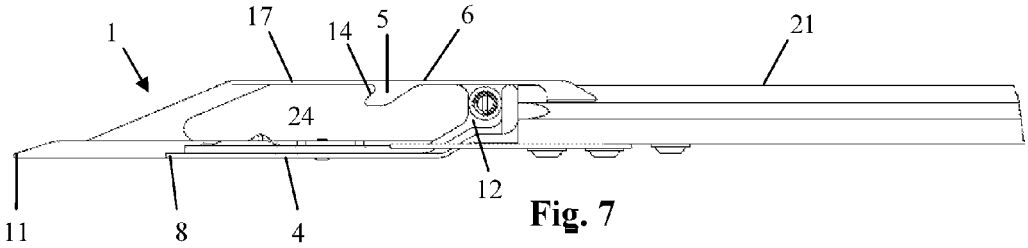
FIG. 7 shows the giver rapier head with part of a drive rod from FIG. 6 in top view.
Figure 8:
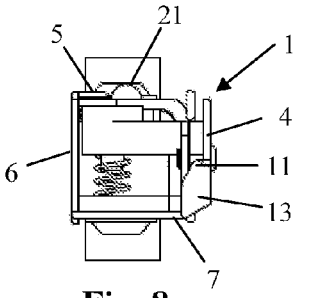
FIG. 8 shows the giver rapier head with part of a drive rod from FIG. 6 in side view, viewed from the left in FIG. 6.
Figure 9:
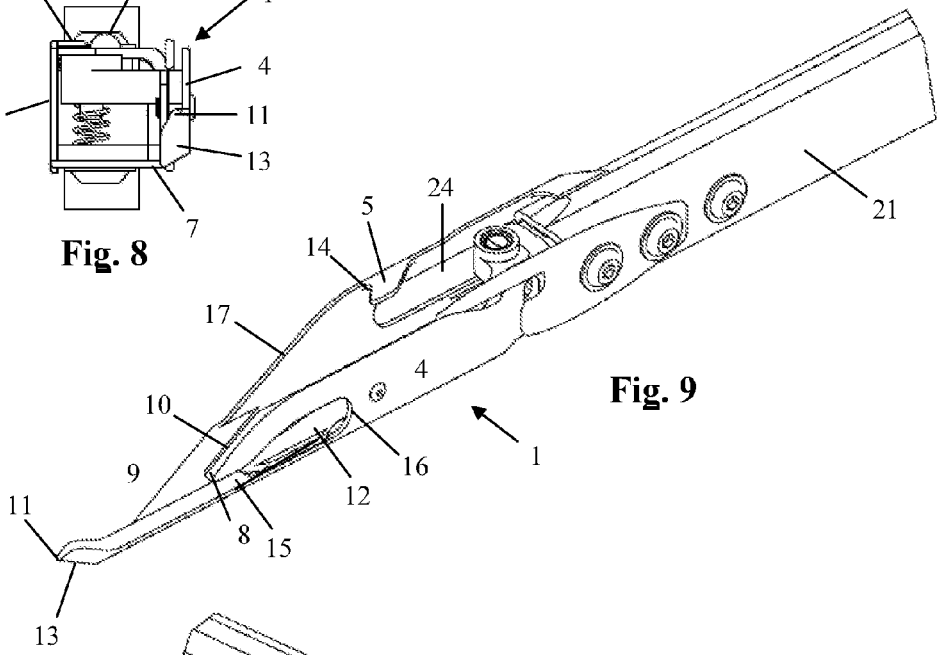
FIG. 9 shows the giver rapier head with part of a drive rod from FIG. 6 in perspective, viewed from the front left in FIG. 6.
Figure 10:
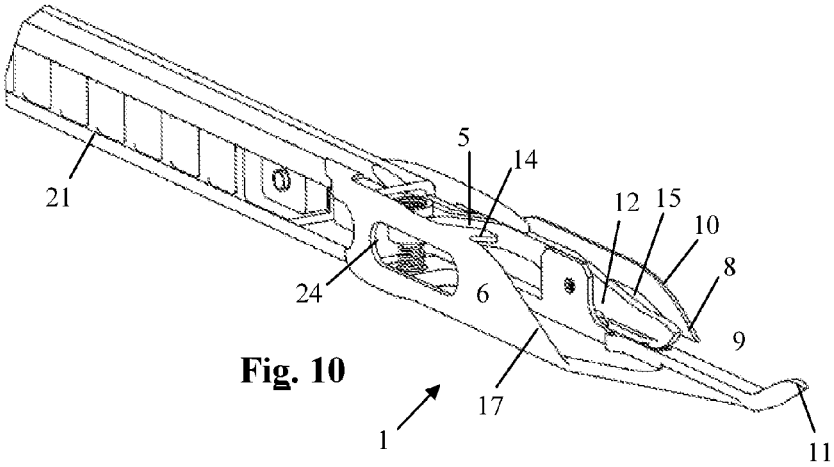
FIG. 10 shows the giver rapier head with part of a drive rod from FIG. 6 in perspective, viewed from the back left in FIG. 6.
Figure 11:
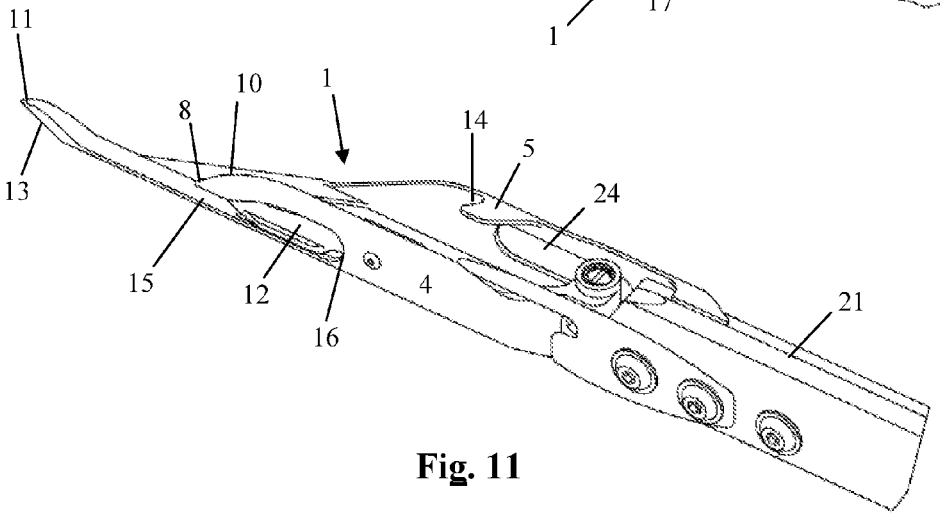
FIG. 11 shows the giver rapier head with part of a drive rod from FIG. 6 in perspective, viewed from the front right in FIG. 6.

At its front side (4), the giver rapier head (1) comprises a guide nose (11) which comprises a first guide arc (13) towards the bottom side (7) for freely guiding warp threads (23) over the bottom side (7). This guide nose (11) is arranged as the first component of the giver rapier head (1), viewed in the direction of movement for inserting a weft thread (2). In FIGS. 4, 6 and 7, this is the point (11) to the far left of the giver rapier head (1). Behind the guide nose (11), a presentation space (9) extends for presenting a weft thread (2) to be inserted therein. This presentation space (9) extends through this giver rapier head (1), viewed at right angles to the front side (4), as can be seen in FIG. 6, so that a weft thread (2) can extend freely through this presentation space (9), as can be seen in FIGS. 2 to 5. To this end, this presentation space (9) is provided with an access opening for this weft thread (2) at the top side (5) of the giver rapier head (1). Behind the presentation space (9), a selection nose (8) is arranged at the front side (4) of the giver rapier head (1). This selection nose (8) comprises a second guide arc (10) for freely guiding warp threads (23) over the top side (5) of the giver rapier head (1). To this end, the top point of the guide nose (11) is situated higher than the bottom point of the selection nose (8), so that warp threads (23) which are not conducted away to the bottom side (7) of the giver rapier head (1) via the first guide arc (13) are securely conducted away via the second guide arc (10) on the top side (5) of the giver rapier head (1). Furthermore, an insertion space (15) extends underneath the selection nose (8), between this selection nose (8) and the bottom side (7) of the giver rapier head (1), for allowing the weft thread (2) to engage therein from the presentation space (9). This insertion space (15) is delimited on its right-hand side by a front stop (16) for allowing the weft thread (2) to strike against it.

On its bottom side (7), the giver rapier head (1) is cut at an angle on the right, viewed from its front side (4) to its rear side (6).

On its rear side (6), the giver rapier head (1), adjacent to the bottom side (7), comprises an arc (17) which runs at an angle from the left of its bottom side (7) to the right of its top side (5) and ends adjacent to the hook-shaped element (14) on the top side (5).

The second embodiment of a giver rapier head (1) according to the present invention which is illustrated in FIGS. 12 to 21 is substantially made from sheet material. To this end, a panel-shaped element is folded to form a substantially tubular body having a front side (4), a top side (5), a rear side (6) and a bottom side (7).

At its top side (5), this tubular body comprises a selection nose (8) for gripping the weft thread (2) on the underside thereof.

At its front side (4), the giver rapier head (1) comprises a guide arc (10) for, on the one hand, guiding a weft thread (2) to be inserted under the selection nose (8) and, on the other hand, freely guiding warp threads over the selection nose (8). The guide arc (10) ends in a point (27) which also forms an outermost point of the giver rapier head (1). This point (27) is arranged as the first point (27) of the giver rapier head (1), viewed in a direction of movement of the giver rapier head (1) for inserting a weft thread (2). In FIGS. 14 to 17, this is the far left-hand point (27) of the giver rapier head (1).

The selection nose (8) of the giver rapier head (1) is arranged completely behind the guide arc (10). The top (26) of the selection nose (8) is positioned facing the guide arc (10).

The selection nose (8) of the giver rapier head (1) is substantially positioned according to the direction of the projection of weft thread (2) which is presented with the positioning element (18) on the top side of the giver rapier head (1). As can be seen in FIG. 12, this direction deviates slightly. When beating up the weft thread (2) with the reed (19), this direction will, however, virtually coincide with the arrangement of the selection nose at a certain point in time, following which this direction will deviate in the opposite direction.

A guide slot (15) extends between the selection nose (8) of the giver rapier head (1) and the guide arc (10) of the giver rapier head (1). At the front side, the giver rapier head (1) furthermore comprises a movable clamping element (12) for clamping a weft thread (2) which has been gripped by the giver rapier (1). In addition, the giver rapier head (1) is also provided with a front stop (16) at its front side for a weft thread (2) which has been gripped by the giver rapier head (1) to strike against.

At its bottom side, the giver rapier head (1) is cut at an angle on the right, viewed from its front side to its rear side, so that this bottom side does not protrude further than the selection nose (8) of the giver rapier head (1) on the left-hand side.

On its rear side, the giver rapier head (1) comprises an arc (17) adjacent to the bottom side and running at an angle from the left at its bottom side to the right at its top side.

Between the selection nose (8) and this ascending arc (17), there is a guide slot (28) which ends in rear stop (14) on the top side of the giver rapier head (1).

In both illustrated embodiments, the giver rapier head (1) is provided with several openings (24) in order to make it as lightweight as possible.

In order to incorporate the giver rapier head (1) in a weaving machine (20), the tubular body thereof is fastened to a drive rod (21) in the illustrated figures. This fastening may be achieved in several known ways. Alternatively, the giver rapier head (1) could, for example, also be fastened to a flexible drive tape to this end.

The first embodiment of a giver rapier head (1) is preferably arranged in the weaving machine (20) in such a way that, when the reed (19) beats up an already inserted weft thread which is still attached to a next weft thread (2) to be inserted (which is connected in turn to the weft yarn store), the next weft thread (2) to be inserted is moved towards the giver rapier head (1) by the movement of the reed (19), so that this weft thread (2) to be inserted is taken up to the location of the presentation space (9), as can be seen in FIGS. 2 and 3.

If the weaving machine does not comprise a selection apparatus for selecting a weft thread (2) to be inserted and presenting this weft thread (2) to the giver rapier head (1), then it preferably comprises a guide arc which guides the weft thread (2) over the guide nose (11) into the presentation space (9) during this movement.

If the weaving machine does contain a selection apparatus for selecting a weft thread (2) to be inserted and presenting this weft thread (2) to the giver rapier head (1), then either this weft thread (2) can also be guided via such a guide arc into the presentation space (9) or the selection of the weft thread (2) does not take place until after the reed (19) has beaten up an already inserted weft thread, in order to present the weft thread (2) to be inserted by means of the selection apparatus directly in the presentation space (9).

In contrast to the prior art, the next weft thread (2) to be inserted is always presented in the presentation space (9) and not outside the giver rapier head (1) according to this method. When the giver rapier head (1) advances, the weft thread (2) engages in the insertion space (15) from this presentation space (9). The weft thread (2) is guided further in here until it is situated underneath the movable clamping element (12), is clamped by this clamping element (12) and strikes against the front stop (16). The weft thread (2) is in this case guided further over the guide arc (17) on the rear side of the giver rapier head (1) until it strikes against the rear stop (14).

The second embodiment of a giver rapier head (1) is preferably arranged in the weaving machine (20) in such a manner that when the reed (19) beats up an already inserted weft thread, this is still connected to a next weft thread (2) to be inserted (which is in turn connected to the weft yarn store) by the movement of the reed (19), the next weft thread (2) to be inserted is moved towards the giver rapier head (1), so that this weft thread (2) to be inserted is gripped underneath the selection nose (8) of the giver rapier head (1). FIG. 12 shows a different possible arrangement, in which this is not the case.

In the preferred arrangement, the next weft thread (2) to be inserted will in this case be gripped first underneath the selection nose (8) and will only then touch the guide arc (10). The guide arc (10) guides this weft thread (2) until it touches the bottom side of the selection nose (8). The weft thread (10) is guided further in the guide slot (13) on the rear side of the giver rapier head (1) and reaches the guide slot (15) on the front side of the giver rapier head (1) via the guide arc (10) on the front side of the giver rapier head (1). On the rear side of the giver rapier head (1), the weft thread (2) is guided until it strikes against the rear stop (14). On the front side of the giver rapier head (1), the weft thread (2) is guided further until it is situated underneath the movable clamping element (12), is clamped by this clamping element (12) and strikes against the front stop (16).

When the weft thread (2) to be inserted has been gripped in the above-described preferred manner by the giver rapier head (1) in the two embodiments, the weft thread (2) to be inserted is cut by means of the cutting device (3) from the already inserted weft thread (2).

In the meantime, the reed (19) is moved backwards. Optionally, the warp yarns (23) are repositioned in order to prepare the next shed (22). The giver rapier head (1) is positioned in the shed (22) in order to insert this weft thread (2) to be inserted in this shed (22), transfer it to the taker rapier and return to its starting position in order to pick up a next weft thread (2) to be inserted.

In this way, the insertion cycle for inserting weft threads (2) is continuously repeated.

The invention claimed is:

1. Giver rapier head for inserting a weft thread in a rapier weaving machine, comprising:

a guide nose which, viewed in the direction of movement for inserting a weft thread, forms the first component of the giver rapier head and which comprises a first guide arc which ends on the bottom side or the top side of the giver rapier head for freely guiding warp threads over said bottom side or top side, wherein the giver rapier head comprises a selection nose which, viewed in said direction of movement, is positioned completely behind the guide nose at an intermediate distance, so that a presentation space extends over a certain distance between the guide nose and the selection nose for presenting therein a weft thread to be inserted to the giver rapier head, wherein said presentation space extends, viewed at right angles to the direction of movement, through the giver rapier head, with an access opening for the weft thread on the top side or the bottom side of the giver rapier head respectively, wherein an insertion space extends between the selection nose and the bottom side or the top side respectively, for allowing the weft thread to engage therein from the presentation space, wherein the selection nose comprises a second guide arc for freely guiding warp threads over the top side or the bottom side respectively, and wherein the point of the guide nose which is furthest from the bottom side or the top side respectively, is situated at least as far from said bottom side or said top side respectively, as the point of the selection nose which is situated furthest from the top side or the bottom side respectively, wherein distance from each nose to each side is measured along a direction which extends at right angles to said direction of movement from the bottom side to the top side.

2. Giver rapier head according to claim 1, characterized in that the guide nose is arranged at the front side of the giver rapier head.

3. Giver rapier head according to claim 1, characterized in that the selection nose is arranged at the front side of the giver rapier head.

4. Giver rapier head according to claim 1, characterized in that the presentation space is suitable for simultaneously presenting several weft threads to be inserted.

5. Giver rapier head according to claim 1, characterized in that the transition of the guide nose from the point of the guide nose, which is positioned furthest from the bottom side or the top side of the giver rapier head respectively, to the presentation space is smooth.

6. Giver rapier head according to claim 1, characterized in that the giver rapier head, at the rear side or the top side or bottom side thereof, comprises a stop to allow the weft thread to strike against it.

7. Giver rapier head according to claim 6, characterized in that the giver rapier head comprises a guide arc at its rear side for guiding the weft thread to said stop.

8. Giver rapier head according to claim 1, characterized in that the giver rapier head is substantially hollow and comprises a movable clamping element for clamping a weft thread which has been gripped behind the selection nose, wherein said clamping element is arranged in the space of the giver rapier head, substantially against the front side of the giver rapier head.

9. Giver rapier comprising a giver rapier head, which is attached to a flexible drive tape or to a rigid drive rod, characterized in that the giver rapier head is a giver rapier head according to claim 1.

10. Rapier weaving machine, comprising a giver rapier head, wherein the giver rapier head is a giver rapier head according to claim 1.

11. Rapier weaving machine according to claim 10, characterized in that the giver rapier head is arranged so as to be displaceable between a first limit position in which a weft thread to be inserted is situated at the location of a central part of this giver rapier head, viewed in the direction of movement for inserting a weft thread, and a second limit position in which the giver rapier head is situated virtually midway along a fabric to be woven using the weaving machine.

12. Rapier weaving machine according to claim 11, characterized in that the weft thread is at the location of the presentation space of this giver rapier head in the first limit position.

13. Rapier weaving machine according to claim 10, characterized in that the rapier weaving machine comprises a reed for beating up an inserted weft thread and comprises a guide element, which is arranged at a fixed position, for guiding a next weft thread to be inserted, which is still attached to the inserted weft thread, when the reed beats up the already inserted weft thread in order to present the next weft thread to be inserted to the giver rapier head.

14. Rapier weaving machine according to claim 13, characterized in that the guide element is configured to guide the next weft thread to be inserted, which is still attached to the inserted weft thread, when the reed beats up the already inserted weft thread in order to present the next weft thread to be inserted over the guide nose of the giver rapier head in the presentation space of the giver rapier head.

15. Rapier weaving machine according to claim 10, characterized in that the rapier weaving machine comprises a cutting device for cutting a weft thread to be inserted from an already inserted weft thread, in which said cutting device is arranged at a fixed position in the rapier weaving machine.

16. Rapier weaving machine according to claim 10, characterized in that the rapier weaving machine comprises a positioning element for positioning a weft thread to be inserted, in which said positioning element is arranged behind the giver rapier head in the rapier weaving machine and is arranged further from the position in the weaving machine where a new fabric to be woven is formed than the giver rapier head.

17. Rapier weaving machine according to claim 16, characterized in that the selection nose of the giver rapier head is arranged substantially according to the direction of the projection of a weft thread which has been presented by said positioning element on the top side of the giver rapier head.

18. Rapier weaving machine according to claim 10, characterized in that the rapier weaving machine is a double-face weaving machine.

19. Method for inserting a weft thread in a rapier weaving machine comprising a reed for beating up an inserted weft thread, wherein the rapier weaving machine is a rapier weaving machine according to claim 10, comprising:

moving a next weft thread to be inserted towards the giver rapier head by movement of the reed in order to present it to the giver rapier head when the reed beats up an already inserted weft thread, which is still attached to the next weft thread to be inserted.

20. Method according to claim 19, characterized in that, moving the next weft thread to be inserted comprises situating said weft thread to be inserted at the location of the presentation space, viewed in the direction of movement for inserting a weft thread.

21. Method according to claim 20, characterized in that moving the next weft thread to be inserted comprises presenting the next weft thread to be inserted in the presentation space of the giver rapier head by the movement of the reed.

22. Method according to claim 21, characterized in that, moving the next weft thread to be inserted comprises guiding the weft thread to be inserted over the guide nose of the giver rapier head with the guide element.

23. Method according to claim 22, characterized in that the rapier weaving machine comprises a selection apparatus for selecting a weft thread to be inserted and presenting said weft thread to the giver rapier head, and further comprising only selecting the next weft thread to be inserted with the selection apparatus after an already inserted weft thread has been beaten up by the reed, so that said next weft thread to be inserted is presented in the presentation space of the giver rapier head.

24. Method according to claim 19, further comprising, when the next weft thread to be inserted is moved towards the giver rapier head by the movement of the reed, gripping said weft thread to be inserted underneath the selection nose of the giver rapier head.

25. Method according to claim 19, characterized in that, after the weft thread to be inserted has been gripped behind the selection nose of the giver rapier head and after said weft thread has been clamped by the clamping element, cutting the weft thread to be inserted from the already inserted weft thread with the cutting device.

* * * * *